United States Patent [19]

Ming

[11] Patent Number: 4,915,665

[45] Date of Patent: Apr. 10, 1990

[54] MODEL AIRPLANE INTERCHANGEABLE BETWEEN HIGH WING AND LOW WING

[76] Inventor: Wong S. Ming, 1001 E. 2nd St., Dayton, Ohio 45402

[21] Appl. No.: 315,540

[22] Filed: Feb. 27, 1989

[51] Int. Cl.[4] ..... A63H 27/00

[52] U.S. Cl. ..... 446/66; 446/34; 446/61

[58] Field of Search ..... 446/34, 61, 62, 63, 446/64, 65, 66, 67, 68

[56] References Cited

U.S. PATENT DOCUMENTS

| | | | |
|---|---|---|---|
| 2,595,074 | 4/1952 | Guillow | 446/66 |
| 4,233,773 | 11/1980 | Jones | 446/34 |
| 4,272,912 | 6/1981 | Lapierre | 446/34 |
| 4,591,114 | 5/1986 | Block | 446/34 X |

FOREIGN PATENT DOCUMENTS

| | | | |
|---|---|---|---|
| 233875 | 11/1944 | Switzerland | 446/34 |
| 378193 | 8/1932 | United Kingdom | 446/66 |

*Primary Examiner*—Robert A. Hafer
*Assistant Examiner*—D. Neal Muir
*Attorney, Agent, or Firm*—Jacox & Meckstroth

[57] ABSTRACT

A model airplane which is readily constructed as either a low wing aircraft or as a high wing aircraft. The model airplane has a fuselage which is provided with a recess in the upper portion thereof and a recess in the lower portion thereof. The model airplane has a wing member which is positionable within either of the recesses. The model airplane has an insert member which is positionable within either of the recesses. Thus, the wing member and the insert member are interchangeable within the recesses to form either a high wing aircraft or a low wing aircraft. Thus, the model airplane can be readily convertible from a high wing aircraft to a low wing aircraft and vice-versa.

14 Claims, 2 Drawing Sheets

MODEL AIRPLANE INTERCHANGEABLE BETWEEN HIGH WING AND LOW WING

BACKGROUND OF THE INVENTION

Model airplanes include two types. One type is a low wing model airplane, and the other type is a high wing model airplane.

It is an object of this invention to provide a model airplane which can be either a high wing model airplane or a low wing model airplane.

Other objects and advantages of this invention reside in the construction of parts, the combination thereof, the method of production and the mode of assembly as will become more apparent from the following description.

SUMMARY OF THE INVENTION

This invention comprises a model airplane which includes a fuselage and a single wing. The wing can be attached to the fuselage to form either a high wing aircraft or a low wing aircraft.

The fuselage has a recess at the lower portion thereof which is adapted to receive the wing. The fuselage has a recess at the upper portion thereof which is adapted to receive the wing. The fuselage includes an insert member which is positionable within the recess at the upper portion of the fuselage and which is also positionable within the recess at the lower portion of the fuselage. When the wing is positioned within the recess at the upper portion of the fuselage the insert member is positioned within the recess at the lower portion of the fuselage. When the wing is positioned within the recess at the lower portion of the fuselage, the insert member is positioned within the recess at the upper portion of the fuselage.

Means are provided for securing the wing within either recess.

Means are provided for securing the insert member within either recess.

DETAILED DESCRIPTION OF THE PREFERRED EMBODIMENT

Figure 1:
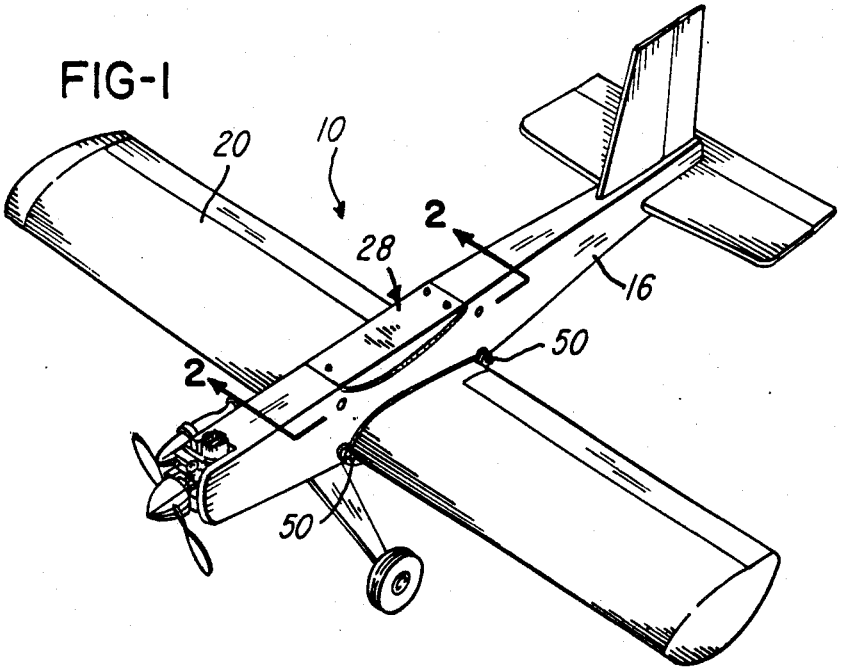
FIG. 1 is a perspective view of a model airplane of this invention. This figure shows the model airplane as a low wing aircraft.
Figure 2:
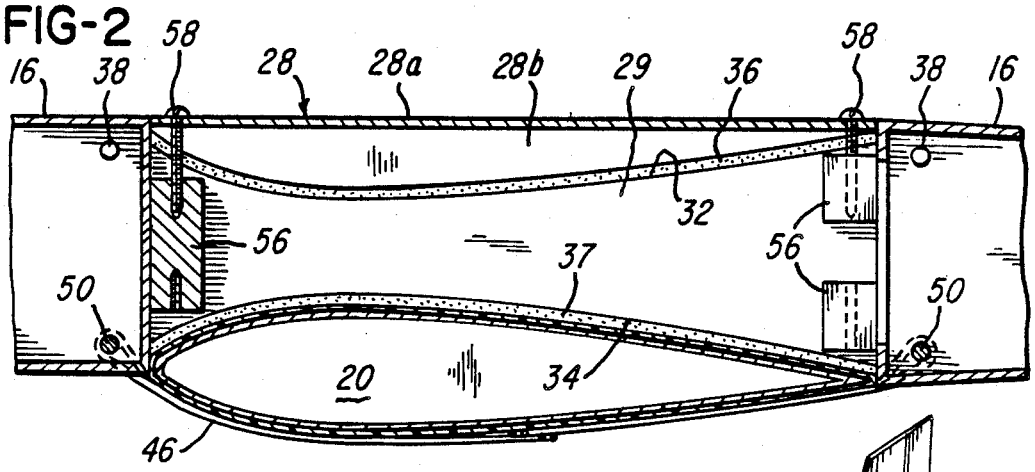
FIG. 2 is a greatly enlarged fragmentary sectional view taken substantially on line 2—2 of FIG. 1.
Figure 3:
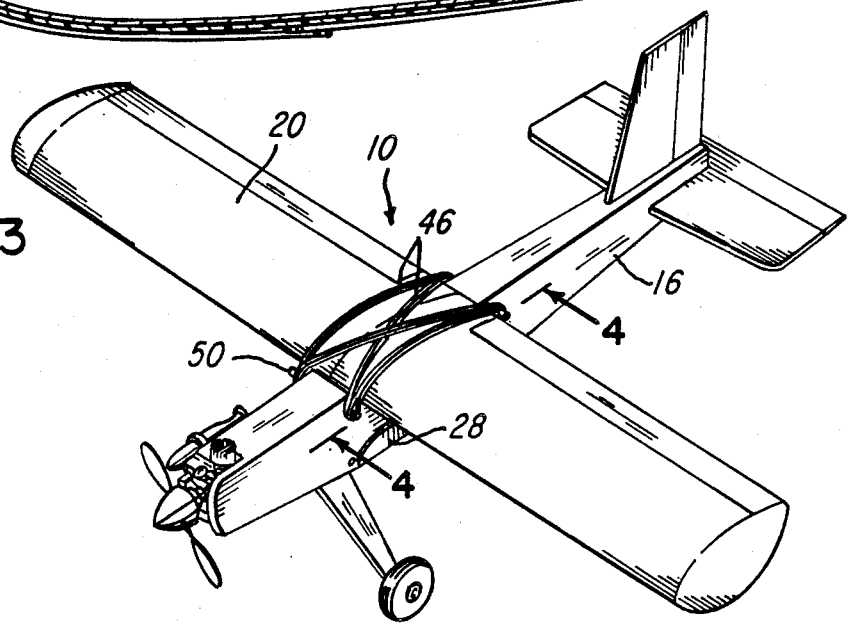
FIG. 3 is a perspective view similar to FIG. 1 and drawn on substantially the same scale as FIG. 1. This figure shows the model airplane as a high wing aircraft.

FIGS. 1 and 3 illustrate a model airplane 10 of this invention. The model airplane 10 includes a fuselage 16, a wing 20, and an insert member 28. The insert member has a main wall 28a and side walls 28b. The fuselage 16 has spaced-apart side walls 29. The side walls 29 form a recess 32 at the upper portion of the fuselage 16 and a recess 34 at the lower portion of the fuselage 16. The upper edges of the side walls 29 are shown as having cushion strips 36 attached thereto, and the lower edges of the side walls 29 are shown as having cushion strips 37 attached thereto. The fuselage 16 has openings 38 adjacent the recess 32 at the upper portion of the fuselage 16. The fuselage 16 has openings 40 therethrough adjacent the recess 34 at the lower portion of the fuselage 16. The wing 20 is positionable in engagement with the walls 29 and within the recess 34 at the lower portion of the fuselage 16, as illustrated in FIGS. 1, 2, and 6.

Figure 6:
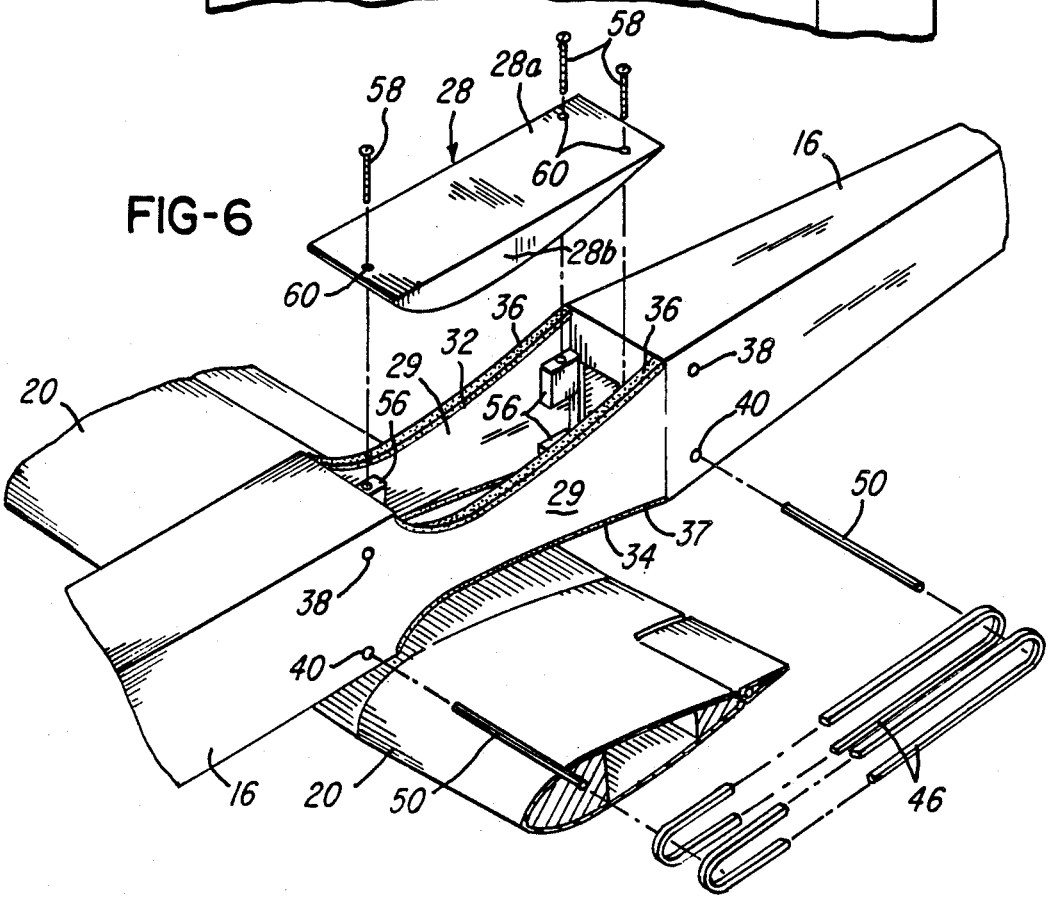
FIG. 6 is a fragmentary exploded perspective view showing arrangement of portions of the airplane as a low wing aircraft.

When the wing 20 is positioned within the recess 34 at the lower portion of the fuselage 16, as shown in FIGS. 1, 2, and 6, the wing 20 engages cushion strips 37 at the lower edges of the side walls 29. The wing 20 is retained in engagement with cushion strips 37 of the side walls 29 and within the recess 34 by means of resilient bands 46. Elongate pins 50 are positioned within the openings 40 in the lower portion of the fuselage 16. The pins 50 extend through the fuselage 16 and have end portions extending laterally from the fuselage 16. The resilient bands 46 engage the wing 20 and encompass the ends of the pins 50 and retain the wing 20 in position within the recess 34, as illustrated in FIGS. 1, 2, and 6.

When the wing 20 is positioned within the recess 34 at the lower portion of the fuselage 16, the insert member 28 is positioned within the recess 32 at the upper portion of the fuselage 16. Within the fuselage 16 and between the side walls 29 are brackets 56. Screw members 58 extend through openings 60 in the insert member 28 and into the brackets 56 and retain the insert member 28 in engagement with the side walls 29 and within the recess 32. Thus, the wing 20 is positioned within the recess 34 at the lower portion of the fuselage 16, and establishes the airplane 10 as a low wing aircraft. When the wing 20 is positioned within the recess 34 at the lower portion of the fuselage 16, the insert member 28 is positioned within the recess 32 at the upper portion of the fuselage 16.

Figure 4:
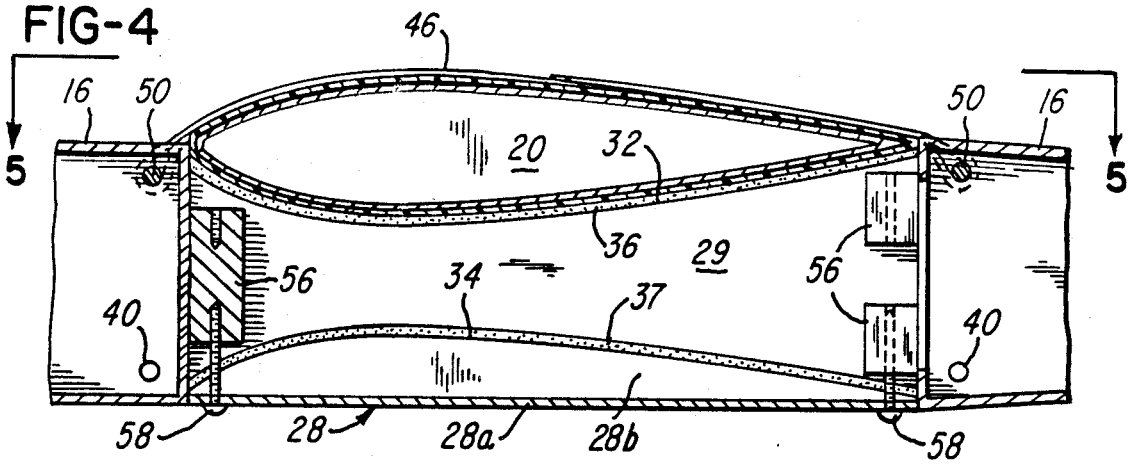
FIG. 4 is a greatly enlarged fragmentary sectional view taken substantially on line 4—4 of FIG. 3.
Figure 5:
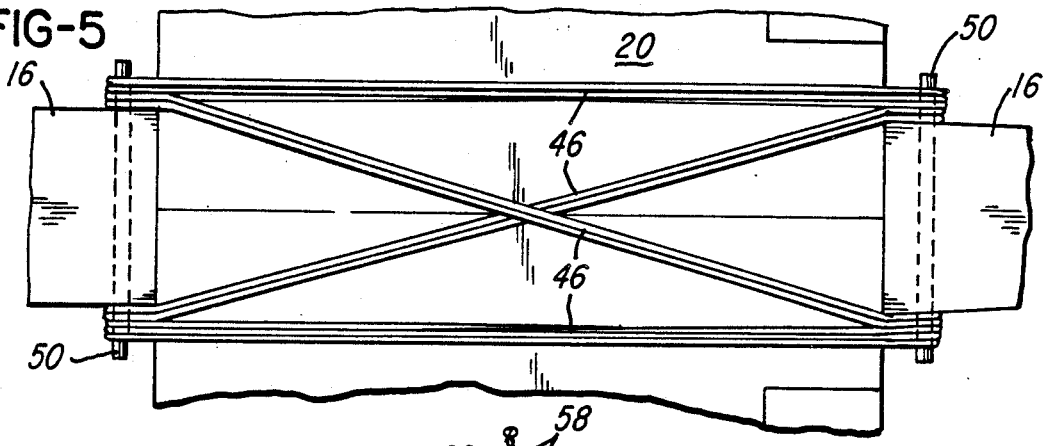
FIG. 5 is a fragmentary plan view taken substantially on line 5—5 of FIG. 4.

As illustrated in FIGS. 3, 4, and 5, the wing 20 is positionable within the recess 32 at the upper portion of the fuselage 16. When the wing 20 is positioned within the recess 32, the wing 20 is maintained in engagement with the cushion strips 36 at the upper edges of the side walls 29 and within the recess 32. The pins 50 are positioned within the openings 38 which are adjacent the upper portion of the fuselage 16, and the pins 50 extend laterally from the fuselage 16. The resilient bands 46 engage the wing 20 and encompass the pins 50 and retain the wing 20 in engagement with the side walls 29 and within the recess 32.

When the wing 20 is positioned within the recess 32, the insert member 28 is positioned within the recess 34 at the lower portion of the fuselage 16. The screws 58 extend through the openings 60 in the insert member 28 and are attached to the brackets 56 within the fuselage 16, as shown in FIG. 4. Thus, the insert member 28 is retained in engagement with the cushion strips 37 of the side walls 29 and within the recess 34.

Thus, the position of the wing 20 at the upper portion of the fuselage 16 establishes the airplane 10 as a high wing aircraft.

Thus, it is understood that this invention provides a model airplane which includes a fuselage and a single wing and in which the wing can be positioned on the fuselage to form a high wing aircraft or the wing can be positioned on the fuselage to form a low wing aircraft.

The wing 20 is readily and easily positioned within either the recess 32 or the recess 34 of the fuselage 16. The insert member 28 is readily and easily positioned within either the recess 32 or the recess 34. The main wall 28a and the side walls 28b of the insert member 28 effectively and attractively fill the recess 32 or 34 within which the insert member 28 is positioned. Due to the fact that the wing 20 and the insert member 28 are interchangeable within the recesses 32 and 34, the airplane 10 has a good appearance when constructed as a high wing aircraft or as a low wing aircraft.

Although the preferred embodiment of the model airplane of this invention has been described, it will be understood that within the purview of this invention various changes may be made in the form, details, proportion and arrangement of parts, the combination thereof, and the mode of assembly, which generally stated consist in a low wing or high wing model airplane within the scope of the appended claims.

The invention having thus been described, the following is claimed:

1. A model airplane comprising a fuselage having an upper portion and a lower portion, the fuselage having a recess in the upper portion thereof, the fuselage having a recess in the lower portion thereof, the model airplane including a wing member and an insert member, the wing member being seatable within the recess at the upper portion of the fuselage, the wing member being seatable within the recess at the lower portion of the fuselage, the insert member being seatable within the recess in the lower portion of the fuselage, the insert member being seatable within the recess in the upper portion of the fuselage, means for retaining the wing member within the recess at the upper portion of the fuselage, means for retaining the wing member in a seated position within the recess at the lower portion of the fuselage, means for retaining the insert member within the recess at the upper portion of the fuselage, and means for retaining the insert member in a seated position within the recess at the lower portion of the fuselage, the insert member being seated within the recess at the upper portion of the fuselage when the wing member is seated within the recess at the lower portion of the fuselage, the insert member being seated within the recess at the lower portion of the fuselage when the wing member is seated within the recess at the upper portion of the fuselage, the wing member and the insert member thus being interchangeably seatable within either recess of the fuselage, whereby the airplane can be constructed as either a low wing aircraft or as a high wing aircraft.

2. The model airplane of claim 1 in which the fuselage comprises spaced-apart side walls, bracket members within the fuselage between the spaced-apart side walls, attachment means for attaching the insert member to the bracket members for securing the insert member in a seated position within either of the recesses of the fuselage.

3. The model airplane of claim 1 which includes pin means extending through the fuselage and resilient means encompassing the pin means and engaging the wing member and retaining the wing member in a seated position within either of the recesses.

4. The model airplane of claim 1 in which the insert member includes a main wall and a pair of side walls.

5. The model airplane of claim 1 in which the insert member includes a main wall and a pair of side walls and in which the fuselage includes a pair of spaced-apart side walls and in which the side walls of the insert member engage the side walls of the fuselage in alignment therewith when the insert member is seated within either of the recesses.

6. The model airplane of claim 1 in which the insert member includes a main wall and a pair of side walls and in which the fuselage includes a pair of side walls and in which the side walls of the insert member engage the side walls of the fuselage when the insert member is seated within either of the recesses.

7. The model airplane of claim 1 in which the fuselage has an upper surface and a lower surface, the recess in the upper portion of the fuselage being a recess in the upper surface of the fuselage, the recess in the lower portion of the fuselage being a recess in the lower surface of the fuselage, and in which the insert member has a main wall, the main wall of the insert member being in alignment with the upper surface of the fuselage when the insert member is seated within the recess at the upper portion of the fuselage, the main wall of the insert member being in alignment with the lower surface of the fuselage when the insert member is seated in the recess at the lower portion of the fuselage.

8. A model airplane comprising a fuselage having an upper portion and a lower portion, means forming a recess in the upper portion of the fuselage, means forming a recess in the lower portion of the fuselage, an insert member positionable within the recess in the upper portion of the fuselage and positionable within the recess in the lower portion of the fuselage, each recess having given dimensions, the insert member having dimensions which are substantially the same as the given dimensions of each recess, whereby the insert member substantially fills the recess within which the insert member is positioned, a wing member positionable within the recess in the upper portion of the fuselage and positionable within the recess at the lower portion of the fuselage, means for attaching the insert member to the fuselage when the insert member is positioned within one of the recesses, and means for attaching the wing member to the fuselage when the wing member is positioned within one of the recesses.

9. The model airplane of claim 8 in which the fuselage includes bracket means, and connection means for attachment of the insert member to the bracket means when the insert member is positioned within one of the recesses.

10. The model airplane of claim 8 in which the fuselage includes bracket means within each of the recesses, and connection means for attachment of the insert member to the bracket means when the insert member is positioned within either of the recesses.

11. The model airplane of claim 8 in which the fuselage includes bracket means within the recess at the lower portion of the fuselage, bracket means within the recess at the upper portion of the fuselage, connection means for attachment of the insert member to the bracket means which is within the recess at the lower portion of the fuselage and for attachment of the insert member to the bracket means within the recess at the upper portion of the fuselage.

12. A method of constructing a model airplane comprising providing a fuselage having an upper portion and a lower portion, forming a recess in the upper portion of the fuselage, forming a recess in the lower portion of the fuselage, providing an insert member, providing a wing member, positioning the insert member within one of the recesses, securing the insert member within the recess within which the insert member is positioned, positioning the wing member within the other recess, securing the wing member within the recess within which the wing member is positioned, whereby the wing member is positionable within either recess and the insert member is positionable within either recess, whereby the model airplane can be constructed as a low wing aircraft or as a high wing aircraft.

13. The method of claim 12 which includes providing attachment means, securing the attachment means within the fuselage, attaching the insert member to the attachment means to secure the insert member within the recess in which the insert member is positioned.

14. A method of constructing a low wing or high wing model airplane comprising providing a wing member having a given width dimension, providing a fuselage having an upper portion and a lower portion, forming a recess in the upper portion of the fuselage in which the recess has a dimension which is substantially equal to the width dimension of the wing member, forming a recess in the lower portion of the fuselage in which the recess has a dimension which is substantially equal to the width dimension of the wing member, providing an insert member which has a dimension substantially equal to said dimension of each recess, positioning the wing member within one of the recesses, whereby the wing member substantially fills the recess within which the wing member is positioned, positioning the insert member within the other recess, whereby the insert member substantially fills the recess within which the insert member is positioned, attaching the wing member to the fuselage, attaching the insert member to the fuselage, whereby the model airplane can be constructed as a low wing aircraft or as a high wing aircraft.

* * * * *